US010315818B2

(12) United States Patent
Gonzalez Sanchez

(10) Patent No.: US 10,315,818 B2
(45) Date of Patent: Jun. 11, 2019

(54) GROUPER MEANS FOR CONTAINERS

(71) Applicant: Jose Francisco Gonzalez Sanchez, Caldes de Montbui (ES)

(72) Inventor: Jose Francisco Gonzalez Sanchez, Caldes de Montbui (ES)

( * ) Notice: Subject to any disclaimer, the term of this patent is extended or adjusted under 35 U.S.C. 154(b) by 0 days.

(21) Appl. No.: 15/565,172

(22) PCT Filed: Apr. 11, 2016

(86) PCT No.: PCT/ES2016/070245
§ 371 (c)(1),
(2) Date: Oct. 9, 2017

(87) PCT Pub. No.: WO2016/162589
PCT Pub. Date: Oct. 13, 2016

(65) Prior Publication Data

US 2018/0057232 A1 Mar. 1, 2018

(30) Foreign Application Priority Data

Apr. 10, 2015 (ES) ..... 201530405 U

(51) Int. Cl.
*B65B 17/02* (2006.01)
*B65D 71/50* (2006.01)

(52) U.S. Cl.
CPC ..... *B65D 71/50* (2013.01); *B65B 17/025* (2013.01)

(58) Field of Classification Search
CPC ..... B65D 71/50; B65D 71/00; B65D 75/00; B65D 25/20; B65D 2581/055; B65D 71/70; A45F 5/10; A45F 5/00; A45F 5/102
USPC ..... 206/158, 427, 145, 139, 159, 147, 151, 206/160; 294/87.2
See application file for complete search history.

(56) References Cited

U.S. PATENT DOCUMENTS 4,235,468 A * 11/1980 Erickson ..... B65D 71/50 294/87.2
4,372,598 A * 2/1983 Quelch ..... B65D 71/50 206/145
5,188,413 A * 2/1993 Nathan ..... B65D 71/50 206/151
5,884,757 A * 3/1999 Prince ..... B65D 71/50 206/153
6,129,397 A * 10/2000 Borg ..... B65D 71/50 206/151

(Continued)

FOREIGN PATENT DOCUMENTS

EP 2537774 A1 * 12/2012 ..... B65D 67/02
WO WO 2011039396 A2 * 4/2011 ..... B65D 71/50

*Primary Examiner* — J. Gregory Pickett
*Assistant Examiner* — Tia Cox

(57) ABSTRACT

A packaging element for can-type containers. The grouper means includes a plurality of protective covers. Each protective cover is linked to a container and includes a top cover provided to cover the top portion of the container and an elongated body formed from a strand-shape structure of flexible material having a hand grip portion. Each protective cover has a widened portion arranged in at least one of the ends of the elongated body and a plurality of attachment portions, with a number complementary to the plurality of protective covers. The plurality of attachment portions are provided to be coupled in a removable way to the plurality of protective covers. The plurality of protective covers and the elongated body are formed from a single injection-molded piece.

11 Claims, 8 Drawing Sheets

(56) References Cited

U.S. PATENT DOCUMENTS

| | | | | |
|---|---|---|---|---|
| 7,588,275 | B2 * | 9/2009 | Borg | B65D 21/0224 206/151 |
| 7,614,495 | B1 * | 11/2009 | Smithers | B65D 81/361 206/150 |
| 2007/0039836 | A1 * | 2/2007 | Borg | B65D 71/50 206/150 |
| 2007/0296231 | A1 * | 12/2007 | Borg | B65D 71/50 294/87.2 |
| 2012/0073997 | A1 * | 3/2012 | Borg | B65D 21/0206 206/150 |
| 2013/0140196 | A1 * | 6/2013 | Gonzalez Sanchez | B65D 67/02 206/161 |

* cited by examiner

FIG 6
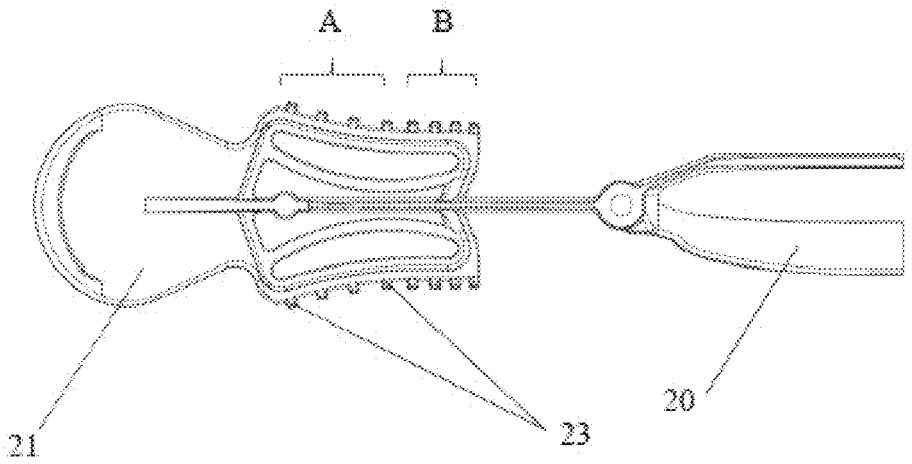
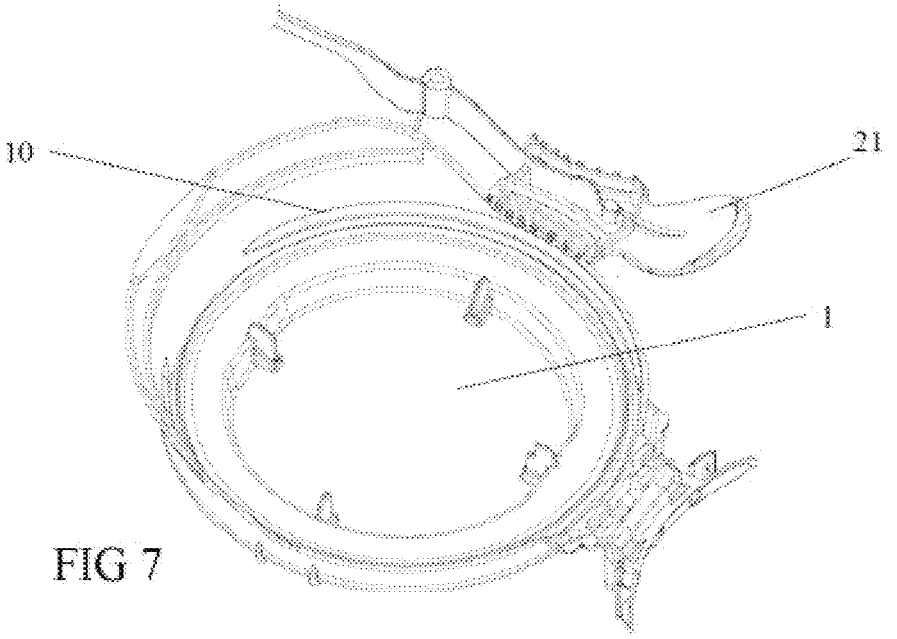
FIG 7

GROUPER MEANS FOR CONTAINERS

OBJECT OF THE INVENTION

The object of the present application is the registration of a grouper means for containers, in particular can-shaped containers.

More specifically, the invention proposes the development of a grouper means for containers, particularly can-shaped containers, provided to contain a beverage or food product, either in solid or liquid state or a combination thereof, the grouper being provided to facilitate the handling thereof by the user, for example, during its acquisition in a sales point.

BACKGROUND OF THE INVENTION

The holder of the invention is the owner of several records related to systems for protecting containers, wherein a top cover is provided to cover the output zone of a container, generally containing a beverage inside.

On the other hand, groupers provided to carry a plurality of containers, especially can-shaped, are widely known in the state of the art, basically formed by a band having a plurality of holes in which each of the containers is adjusted by a snap-fit connection. However, in the case of assembling the protective covers on the containers, it involves the arrangement of the different and independent packaging elements from a manufacturing point, further requiring two steps in the process, one step to place the covers and a second step to introduce the band over a group of containers, thus increasing the packaging time and therefore the packaging costs.

In addition, the applicant does not know of any invention at present having all the characteristics described in this specification.

DESCRIPTION OF THE INVENTION

The present invention has been developed with the aim of providing a grouper means for containers, which is designed as a novelty within the field of application and solves the aforementioned drawbacks, also providing other additional advantages, which will be apparent from the accompanying description below.

Thus, an object of the present invention is to provide a grouper means for containers, comprising the following parts:

- a plurality of protective covers, wherein each protective cover is linked to a container, comprising a top cover provided to cover the top part of the container;
- an elongated body formed from an essentially strand-shaped structure of flexible material having a hand grip portion; a widened portion arranged in at least one of the ends of the elongated body; and a plurality of attachment portions, with a number complementary to the plurality of protective covers, provided to be coupled in a removable way to the plurality of protective covers.

As a result of these characteristics, the manufacturing and assembly process of the protective covers together with a grouper for containers is facilitated and its costs are reduced, due to the reduction in the number of independent components and, therefore, of steps in the process. Another equally significant advantage is the fact that it is easily stacked, so it takes up less space when they have to be either grouped in a warehouse or transported in a bottling plant.

The plurality of protective covers and the elongated body are formed from a single injection-moulded piece.

According to another aspect of the invention, the grip portion is defined by an extension that is closed at both ends and attached to the remainder of the body by way of a handhold.

According to an additional characteristic, each of the attachment portions is formed by a flange having an arched path, which is provided with a weakened zone, formed by breaking points.

Advantageously, the widened portion consists of an essentially teardrop-shaped tab which makes it easier for the user to tear the breaking zone in order to separate the containers from the elongated body, this tab having dimensions that facilitate the handling thereof with the fingers of the user.

According to an alternative embodiment of the invention, the protective cover includes a hinged segment provided to execute an angular movement of the top cover relative to the top face of the container, where the hinged segment comprises a fastening extension with a contact surface provided to be adhered to the container by means of an adhesive material to perform the opening and closing action of the top cover.

Preferably, each one of the aforementioned attachment portions is directly coupled to the protective cover.

According to another aspect of the invention, each one of the attachment portions includes one pair of elongated windows, each window being linked to a protective cover. This aspect provides an elastic deformation of the attachment portion, which avoids unintentional breakage of the teeth which are present in the attachment portion, since it reduces the stresses that these teeth must bear, and moreover, it enables the beverage containers (cans) to be lifted and transported in such a way that each of the beverage containers is arranged on a vertical axis when a user transports the grouper with containers incorporated by the provided handles.

Other characteristics and advantages of the grouper means for containers, object of the present invention, will become clear in light of the description of a preferred but not exclusive embodiment of the invention, illustrated by way of non-limiting example in the accompanying drawings, in which:

BRIEF DESCRIPTION OF THE DRAWINGS

FIG. 6 is a detailed plan view of an attachment portion that forms part of the grouper means;

FIG. 7 is a detailed perspective view of a segment of the grouper means where the attachment of the protective cover to the elongated body is shown;

DESCRIPTION OF A PREFERRED EMBODIMENT

Figure 1:
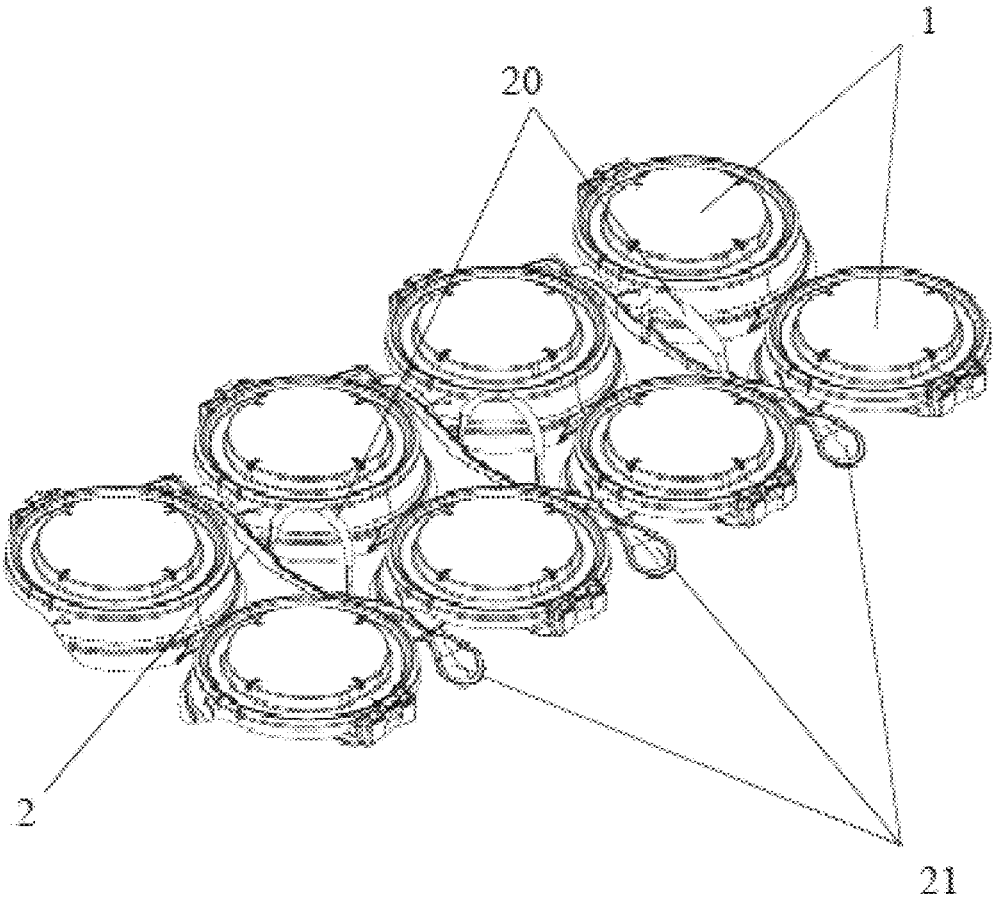
FIG. 1 is a perspective view of an embodiment of a grouper means for containers according to the present invention.
Figure 2:
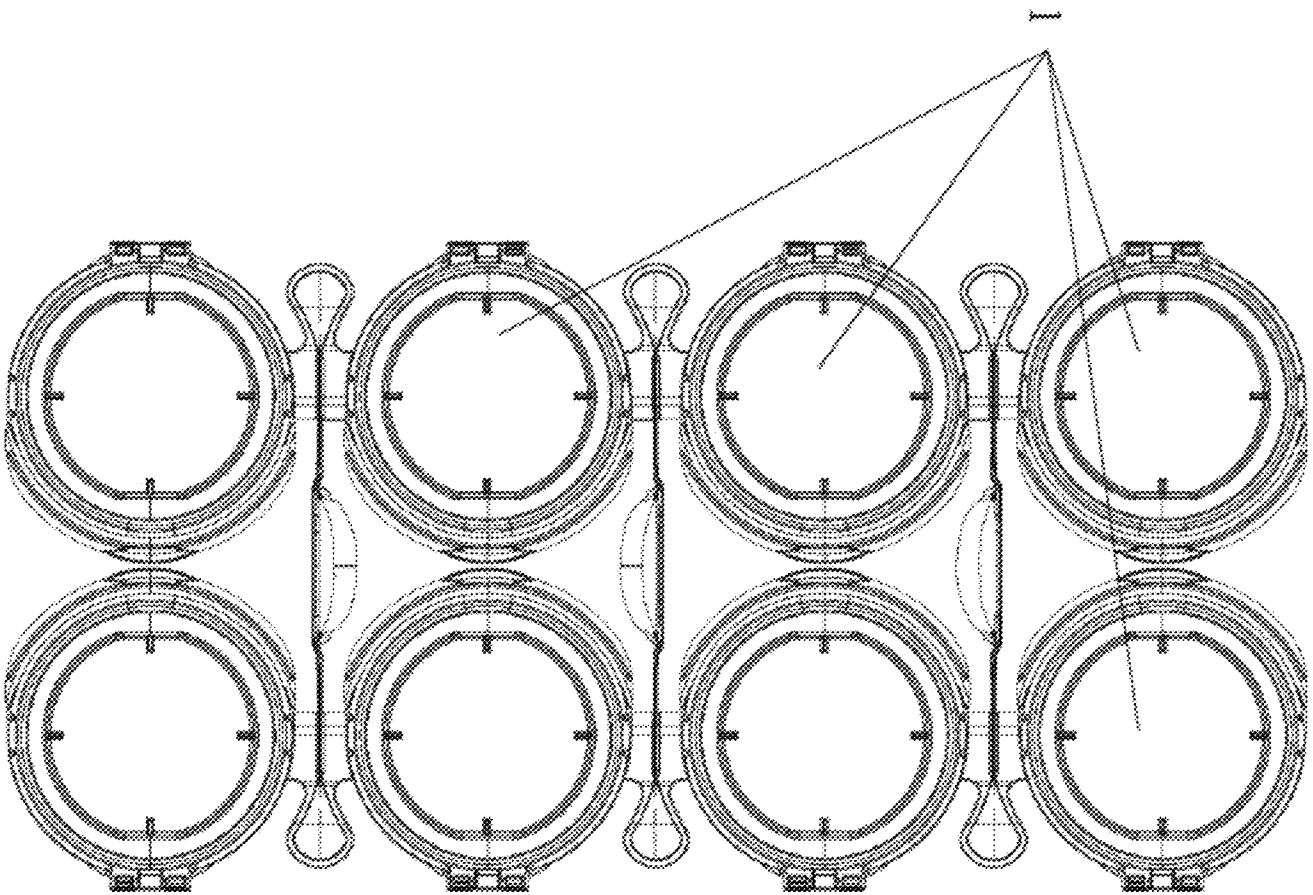
FIG. 2 is a top plan view of the grouper means represented in the previous figure.
Figure 3:
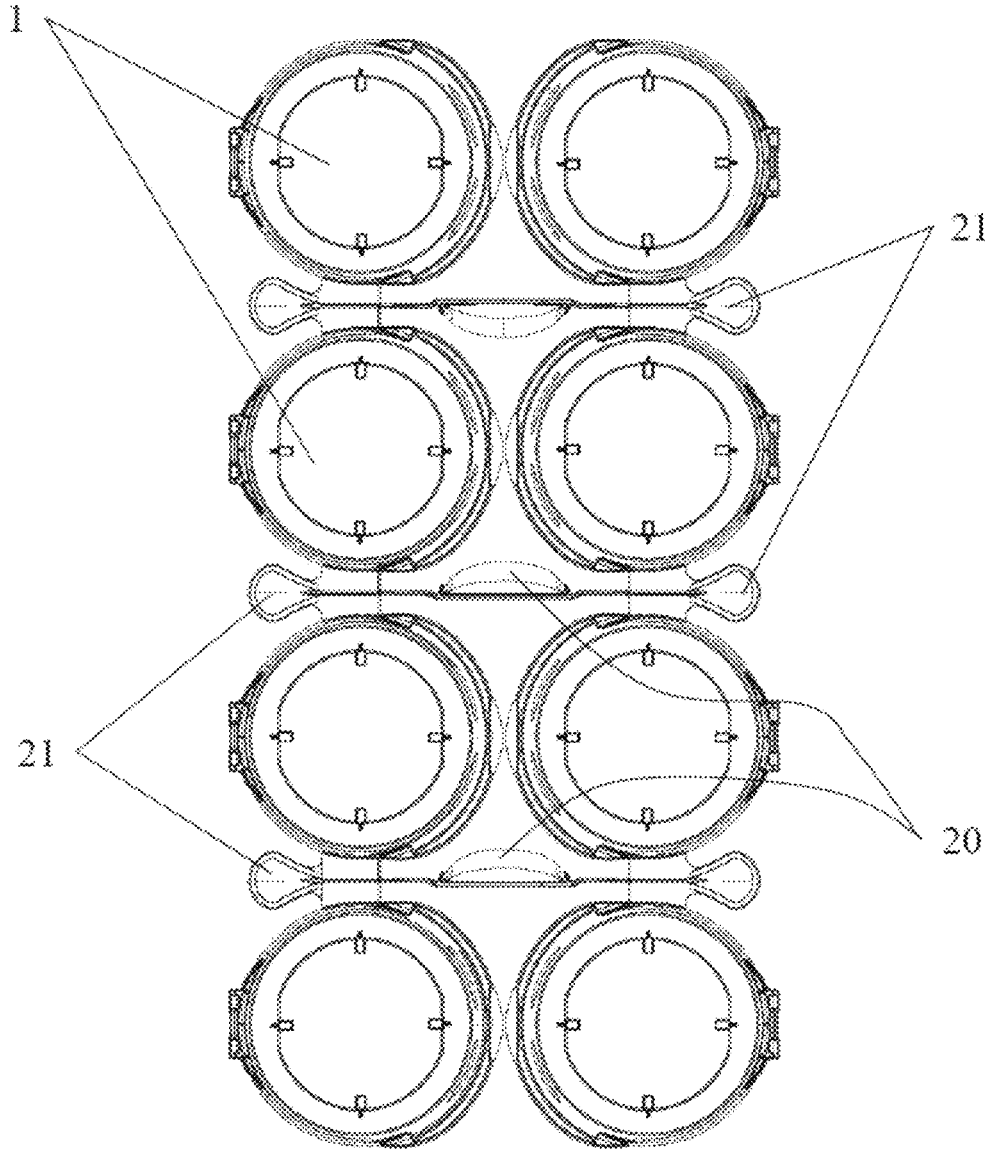
FIG. 3 is a bottom plan view of the grouper means represented in FIG. 1.

In light of the aforementioned figures and, according to the numbering adopted, one may observe therein a preferred embodiment of the invention that comprises the parts and elements that are indicated and described in detail below.

According to an embodiment of the grouper means for containers, it mainly comprises a plurality of protective covers, generally indicated with the reference (1), which are linked to each one of the containers to be transported and an elongated body (2) formed from an essentially strand-shape structure of flexible material where all the protective covers are attached. It should be noted that the plurality of protective covers (1) and the elongated body (2) are formed by conventional injection means from a single injection-moulded piece of plastic material.

These protective covers (1) have a top cover provided to cover the top part of the container and a hinged segment provided to execute an angular movement of the top cover relative to the top face of the container, the hinged segment comprises a fastening extension with a contact surface provided to be adhered to the container by an adhesive material.

Now with particular reference to the elongated body (2), it is formed from an essentially strand-shape structure of flexible material having a hand grip portion (20); a widened portion (21) arranged on each one of the ends of the elongated body (2), which consists of an essentially tear-drop-shaped tab; and a plurality of attachment portions (22), with a number complementary to the plurality of protective covers (1), provided to be coupled in a removable way to the plurality of protective covers (1).

In more detail, the hand grip portion (20) is defined by an extension closed at both ends thereof and attached to the remainder of the elongated body by way of a handhold, such that it allows at least one finger to pass through each one of the hand grip portions (20) which are present in the grouper means.

Figure 4:
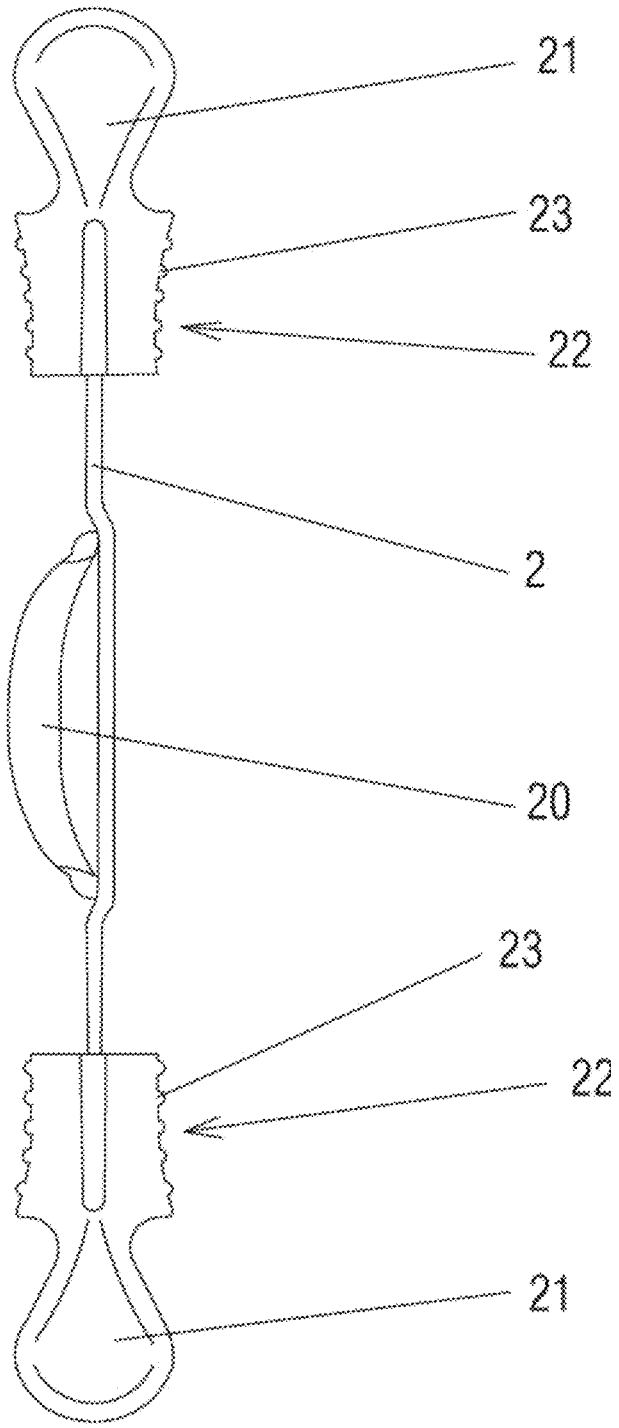
FIG. 4 is a plan view of the elongated body only.
Figure 5:
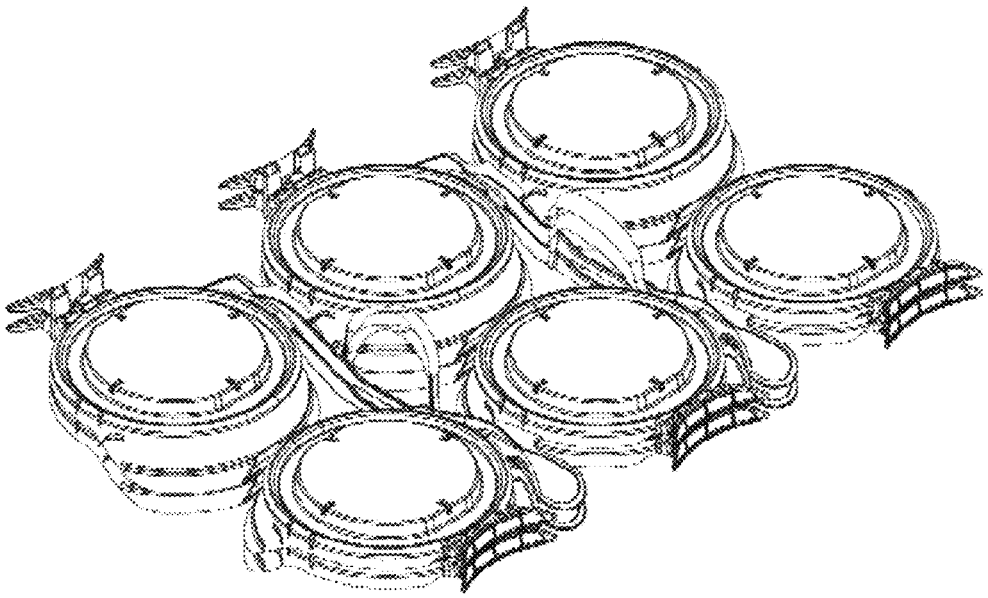
FIG. 5 is a perspective view of two grouper means according to the invention stacked one on top of the other.

As can be more clearly be seen in FIG. 4, each one of the attachment portions (22) is formed by a flange with an arched path provided with a weakened zone formed by a plurality of breaking points which is easily breakable when the user pulls the widened portion (21) with a predetermined force. In the example represented, each elongated body (2) has four attachment portions (22), arranged in pairs. It should be mentioned that the attachment portions (22) have a larger cross-section with respect to the remainder of the elongated body (2).

As can be seen in the embodiment represented in FIGS. 6 and 7, the breaking points of each of the attachment portions (22) are comprised by a plurality of teeth. More specifically, the plurality of teeth (23) has a first segment (A) and a second segment (B) of teeth (23), such that the first segment (A) is arranged nearer to a free end of the laminar body (2), wherein the first segment (A) has a greater distance between teeth than the existing distance between teeth in the second segment (B). Thus, by means of the arrangement of these two different segments (A, B), the teeth are closer to each other in the zone that has to endure a stronger force during the transporting action of the containers performed by a buyer user, while the teeth (23) are further apart at the starting point of breakage in order to carry out the separation of the protective cover (1) from the elongated body (2). Thus, a balance between facilitating the removal of the protective covers (1) from the elongated body (2) and not breaking said area when a user holds a grouper means provided with containers is achieved.

It should be mentioned that the attachment portions (22) have the ability to elastically deform such that it reduces the possible stresses that the teeth (23) suffer when a user manually lifts and transports the grouper means with containers placed therein.

The inside of each one of the protective covers (1) includes a pair of negative or reinforcing projections (10) diametrically opposite from each other that protrude inwardly, arranged side by side of the hinge that is present on each protective cover (1), which have a dual function. On the one hand, it keeps the protective cover (1) coupled to the container through a diametric projection on the top portion of the container and, on the other hand, it also facilitates the opening thereof, having an adequate thickness to comply with the dual function.

Figure 8:
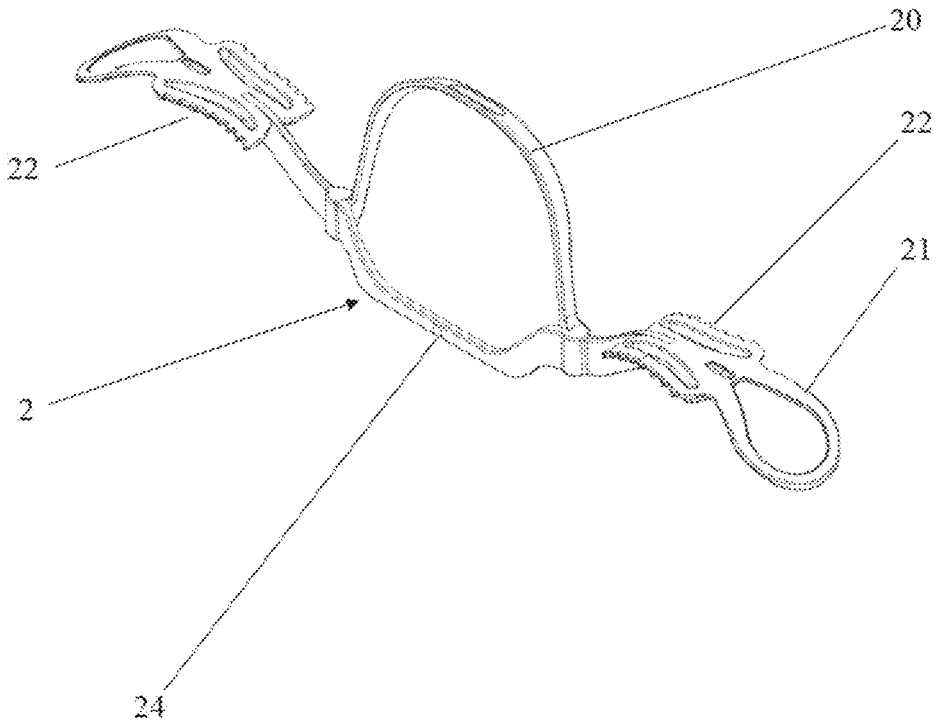
FIG. 8 is a perspective view of a second embodiment of the elongated body that forms part of the grouper means.

Referring to FIG. 8, it can be seen how the elongated body (2) may additionally be provided with a weakened area (24) in the middle of the elongated body (2) itself, located between the attachment points of the hand grip (20) with the elongated body (2), the weakened area (24) being formed by a notch or segment of a transversal cross-section that is smaller than the remainder of the elongated body (2). The objective of this weakened area (24) is to facilitate the degradation of the grouper means as a result of biodegradation. Moreover, facilitating the breakage at that point also prevents the grouper means from becoming a trap for animals, such as fish, if it is found in an aquatic environment after its useful life.

Figure 9:
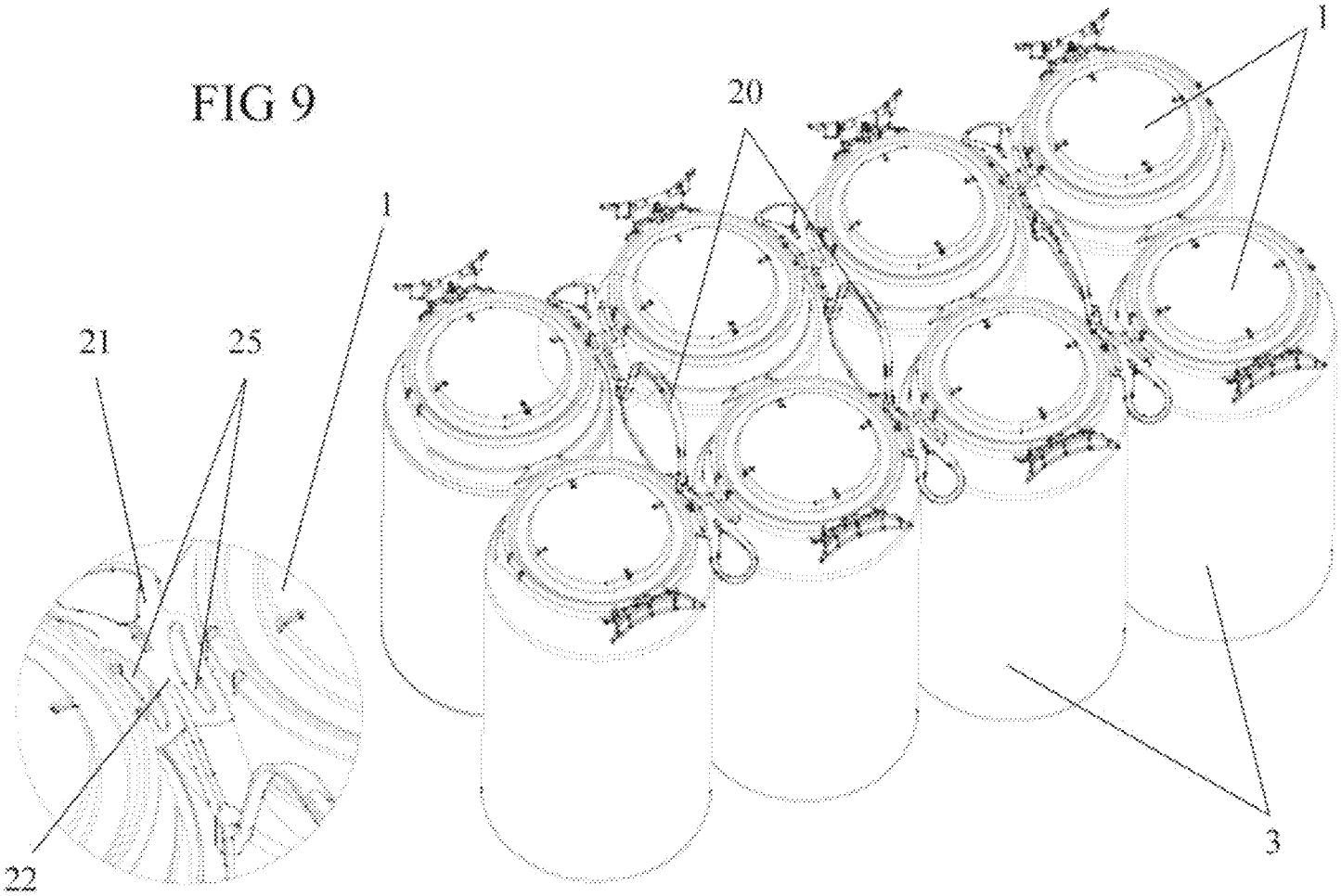
FIG. 9 is a perspective view of a second embodiment of the grouper according to the present invention.

As may be in seen in FIG. 9, another embodiment of a grouper for containers with supported containers (3) is shown, wherein the common elements have same numbering, where each one of the attachment portions (22) includes a pair of elongated windows (25) significantly parallel to each other that provide a higher elastic deformation of the attachment portion (22) when the grouper is being transported and held by the hand grip (20), each elongated window being linked to a protective cover.

The details, shapes, dimensions, and other auxiliary elements used to manufacture the grouper means for containers of the invention may be suitably substituted for others that do not diverge from the scope defined by the claims included below.

What is claimed is:

1. A packaging element for containers, comprising:

a plurality of protective covers (1), wherein each protective cover is linked to a container, comprising a top cover provided to cover the top part of the container;

an elongated body (2) formed from a strand-shape structure of flexible material having a hand grip portion; a widened portion arranged in at least one of the ends of the elongated body (2); and a plurality of attachment portions (22), with a complementary number to the plurality of protective covers (1), being said plurality of attachment portions (22) provided to be coupled in a removable way to the plurality of protective covers being breaking points of each of the attachment portions (22) comprised by a plurality of teeth (23); and wherein the plurality of protective covers (1) and the elongated body (2) are formed from a single injection-moulded piece wherein the fact that the plurality of teeth (23) has a first segment (A) and a second segment (B) of teeth, such that the first segment (A) is arranged nearer to a free end of the elongated body (2), wherein the first segment (A) has a distance between teeth greater than the distance between teeth in the second segment (B).

2. The packaging element according to claim 1, wherein the fact that the grip portion is defined by an extension closed at both ends and attached to the remainder of the elongated body by way of a handhold.

3. The packaging element according to claim 1, wherein the fact that each one of the attachment portions is formed by a flange with an arched path which is provided with a weakened zone formed by breaking points.

4. The packaging element according to claim 1, wherein the fact that the widened portion consists of a teardrop-shaped tab.

5. The packaging element according to claim 1, wherein the fact that the protective cover (1) includes a hinged segment provided to execute an angular movement of the top cover relative to the top face of the container, the hinged segment comprises a fastening extension with a contact surface provided to be adhered to the container by means of an adhesive material.

6. The packaging element according to claim 1, wherein the fact that each one of the attachment portions (22) is coupled to the protective cover (1).

7. The packaging element according to claim 1, wherein the fact that the attachment portions (22) have a larger cross-section with respect to the remainder of the elongated body.

8. The packaging element according to claim 1, wherein the fact that a weakened area (24) is provided in the middle of the elongated body located between the attachment points of the grip portion with the elongated body (2), the weakened area being formed by a segment of a cross-section that is small than the remainder of the elongated body (2).

9. The packaging element according to claim 1, wherein the fact that the inside of each one of the protective covers (1) includes a pair of negative or reinforcing projections (10) diametrically opposite from each other that protrude inwardly.

10. The packaging element according to claim 1, wherein the fact that each one of the attachment portions (22) includes a pair of elongated windows (25), each elongated window (25) being linked to a protective cover.

11. The packaging element according to claim 5, wherein the fact that each one of the attachment portions (22) is coupled to the protective cover (1).

* * * * *